US007559411B2

(12) United States Patent
Michel et al.

(10) Patent No.: US 7,559,411 B2
(45) Date of Patent: Jul. 14, 2009

(54) HANDBRAKE HAVING INPUT LOAD LIMITER

(75) Inventors: Mark Michel, Greer, SC (US); Robert Shepherd, Pelzer, SC (US)

(73) Assignee: Ellcon National, Inc., Greenville, SC (US)

( * ) Notice: Subject to any disclaimer, the term of this patent is extended or adjusted under 35 U.S.C. 154(b) by 428 days.

(21) Appl. No.: 11/519,122

(22) Filed: Sep. 11, 2006

(65) Prior Publication Data

US 2007/0151812 A1 Jul. 5, 2007

Related U.S. Application Data

(60) Provisional application No. 60/718,292, filed on Sep. 19, 2005.

(51) Int. Cl.
*B61H 13/02* (2006.01)
*B61H 13/34* (2006.01)
*F16D 65/28* (2006.01)
*G05G 1/04* (2006.01)

(52) U.S. Cl. ..... 188/34; 188/71.2; 188/72.9; 188/107; 74/505

(58) Field of Classification Search ..... 188/3 R, 188/33, 34, 71.2, 72.9, 107; 74/505; 192/12 B, 192/12 BA, 15, 18 R
See application file for complete search history.

(56) References Cited

U.S. PATENT DOCUMENTS 4,236,424 A 12/1980 Kanjo et al. ..... 74/505
4,282,771 A 8/1981 Grube ..... 74/505
4,368,648 A 1/1983 Houseman et al. ..... 74/505
4,706,791 A 11/1987 Magliano ..... 192/223.2
6,039,158 A * 3/2000 Fox et al. ..... 188/34
6,427,811 B1 * 8/2002 Wedge et al. ..... 188/34
6,789,855 B2 9/2004 Herron ..... 303/13
6,848,754 B2 2/2005 Ring et al. ..... 303/71
2007/0056814 A1 * 3/2007 Michel et al. ..... 188/196 B

* cited by examiner

*Primary Examiner*—Thomas J Williams
(74) *Attorney, Agent, or Firm*—Nelson Mullins Riley & Scarborough, LLP

(57) ABSTRACT

A brake mechanism for activating the brake rigging of a railway car, the brake mechanism comprising a shaft having axial splines formed on one end thereof, a handle rotatably coupled to the shaft so that the handle is rotationally fixed to the shaft in a first direction and rotates relative to the shaft in an opposite second direction. A first gear is connected to the railway car brake rigging, a second gear is in operative engagement with the shaft splines, and a clutch is operatively disposed between the first gear and the second gear, the clutch having a coupler for rotationally coupling the first gear and the second gear and at least one spring operatively disposed intermediate the first gear and the second gear for biasing the coupler into engagement with the second gear. The coupler is moveable between a first position in which the first gear is rotationally coupled to the second gear, and a second position in which the first gear rotates with respect to the second gear.

20 Claims, 5 Drawing Sheets

INPUT AT SET POINT

INPUT NEARING SET POINT

INPUT MUCH LESS THAN SET POINT

HANDBRAKE HAVING INPUT LOAD LIMITER

CLAIM OF PRIORITY

This application claims priority to U.S. Provisional Patent Application No. 60/718,292, filed Sep. 19, 2005, the entire disclosure of which is incorporated by reference herein.

BACKGROUND OF THE INVENTION

This invention relates to hand operable brake mechanisms and particularly, to a handbrake load limiter for railway cars.

Railway car handbrake mechanisms are well known and may include a rotatable wheel or lever that provides upward tension on a chain that is secured at its distal end to a brake rigging of the railway car. Sufficient force must be applied on the brake shoes of the railway car to releasably secure the wheels in a locked position to prevent the railway car from moving. An under applied brake can result in unwanted movement of the car, for example a runaway car. On the opposite end of the spectrum, an over applied brake may result in damage or failure to the brake rigging.

Previously, it has been industry standard to apply 125 pounds of force to the end of the brake lever or 125 pounds of torque force on a wheel to properly apply the handbrake. Currently, certain segments of the railway industry have lowered the 125 pound requirement to 74 pounds. This lowered threshold can result in many more instances when the handbrake is over applied. When the brake is to be fully applied with 125 pounds, there exists the possibility of the handbrake being under applied. Thus, a mechanism is needed that alerts the operator when the brake is properly applied to within a predetermined range and prevents the application of excessive input force.

SUMMARY OF THE INVENTION

The present invention recognizes and addresses the foregoing disadvantages, and others, of prior art constructions and methods.

The present invention provides a brake mechanism for activating the brake rigging of a railway car. The brake mechanism comprises a housing, a handle mechanism coupled to the housing, a quick release mechanism mounted in the housing and in operative engagement with the first shaft, and a chain drum mechanism.

The handle mechanism has a first handle, a first shaft rotatably received in the first handle and the housing, a first ratchet wheel rotationally fixed to the first shaft, and a first pawl mounted proximate to, and in operative engagement with the first ratchet wheel. The first pawl is biased into engagement with the first ratchet wheel and rotationally fixes the first ratchet wheel in a first direction while ratcheting over the first ratchet wheel in an opposite second direction.

The quick release mechanism has a second handle rotatably coupled to the housing, a second ratchet wheel rotationally fixed to the first shaft, and a second pawl rotatably coupled to the housing and in operative engagement with the first and the second handles. The chain drum mechanism has a second shaft, a first gear connected to the railway car brake rigging, a second gear rotatably mounted on the second shaft and in operative engagement with the first shaft, and a clutch mounted on the second shaft intermediate the first gear and the second gear. The clutch is moveable between a first position in which the first gear is rotationally coupled to the second gear, and a second position in which the first gear rotates with respect to the second gear.

The first shaft may define axial splines thereon that rotationally couple the second gear to the first spline so that rotation of the first shaft in the first direction causes the second gear to rotate in the opposite second direction. The second gear may define a plurality of ramped teeth on an end thereon, and the clutch may define a plurality of ramped teeth on an end thereon, wherein the second gear and the clutch are positioned so that the second gear teeth and the clutch teeth are in engagement with each other. When the second gear rotates in the second opposite direction, the second gear can rotate with respect to the clutch when a predetermined input torque is reached and the second gear is rotationally fixed with the clutch in the first direction.

The clutch may have a splined hub rotatably received on the second shaft, the splined hub being rotationally fixed to the first gear. A clutch may also contain a coupler received on, and rotationally fixed to, the splined hub, where the coupler is positioned between the second gear and the splined hub. At least one spring is positioned intermediate the splined hub and the coupler for biasing the coupler into engagement with the second gear. The clutch may also have an adjustment plate for adjusting the level of the predetermined torque required for the second gear to rotate with respect to the clutch.

The second handle may be rotated to cause the second pawl to disengage from the second ratchet wheel allowing the first shaft to rotate in the second opposite direction. The second pawl is releasably maintained in the disengaged position so that the torque applied to the railway car brake rigging is fully released. The second pawl may be biased back into engagement with the second ratchet wheel by rotating the first handle to prevent the first shaft from rotating in the second opposite direction.

A chain may be in operative engagement with the first gear and the railway car brake rigging such that rotation of the first shaft in the first direction causes the chain to engage the railway car brake rigging.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
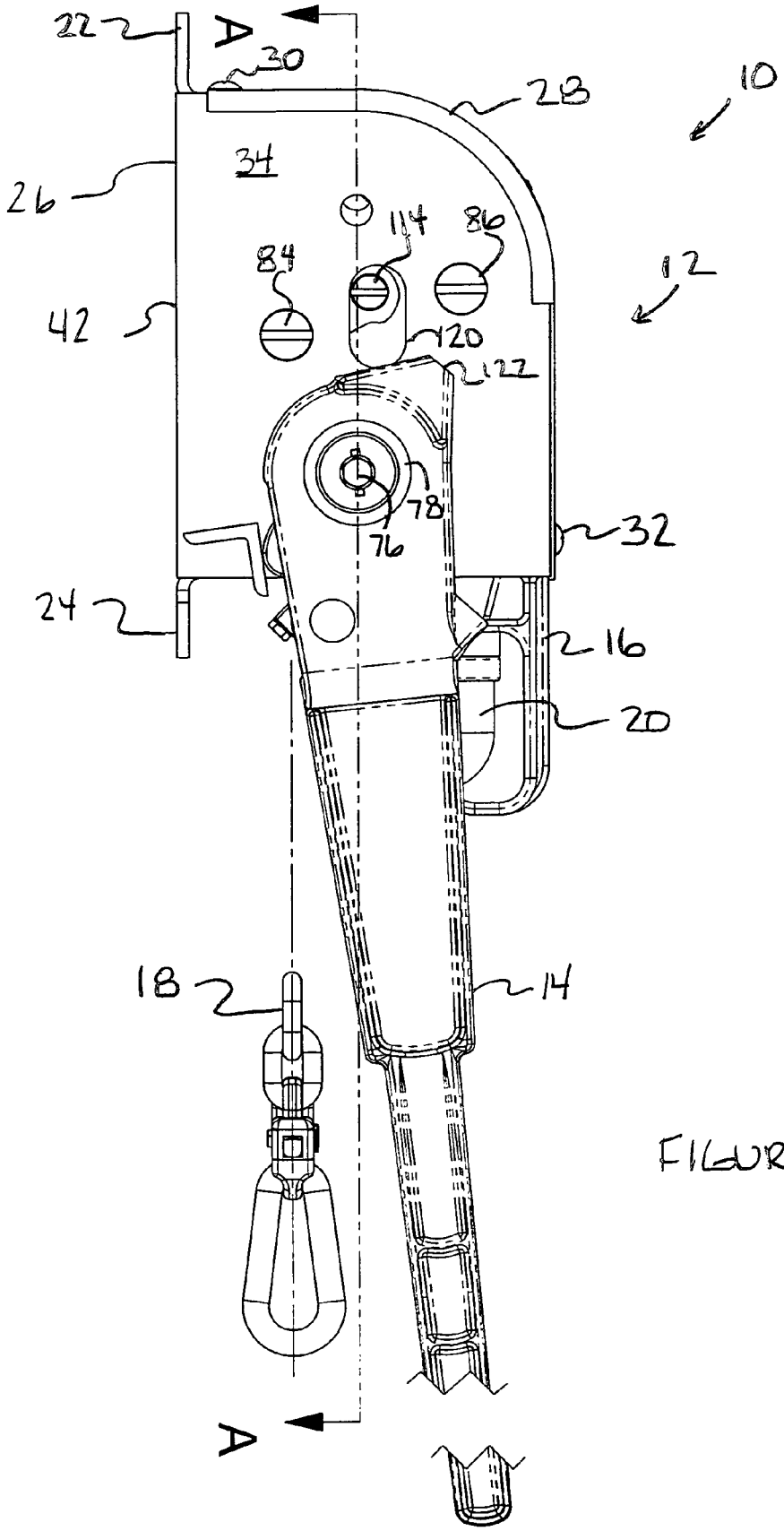
FIG. 1 is a side view of the hand brake mechanism of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1 a handbrake mechanism 10 generally comprises a housing 12, a handle 14 rotatably coupled to a gear mechanism (not shown), a quick release handle 16 operatively connected to the gear mechanism, a chain 18 coupled to the gear mechanism, a weight 20 coupled to one end of chain 18, and a pair of mounting flanges 22 and 24 to facilitate mounting of the handbrake to a railway car.

Figure 2:
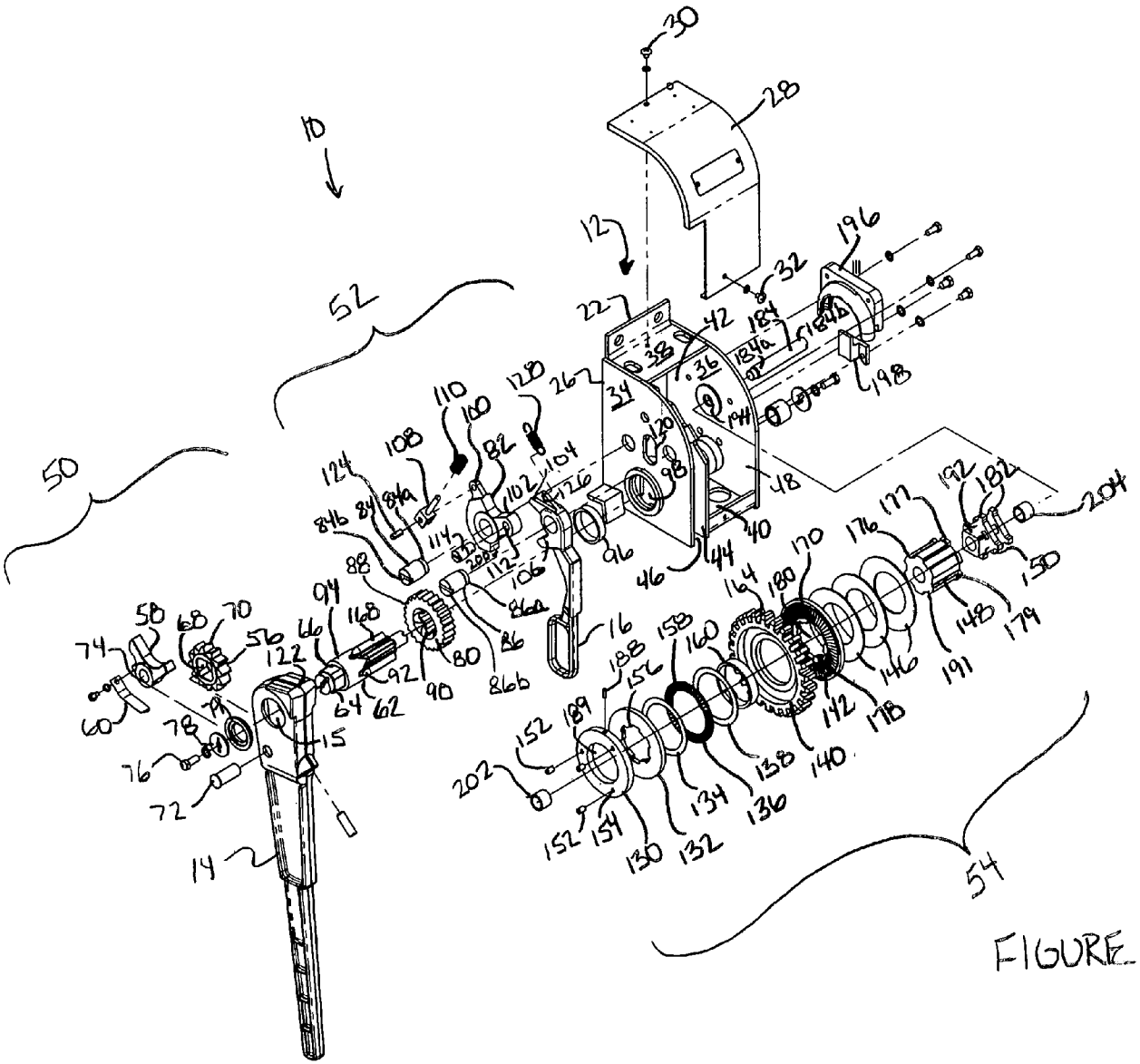
FIG. 2 is an exploded perspective view of the hand brake of FIG. 1.

With reference to FIG. 2, housing 12 is shown having a casing 26 and a cover 28, which is secured to the casing by fasteners 30 and 32. In one preferred embodiment, fasteners 30 and 32 are screws. Also referring to FIG. 3, casing 26 has a first side wall 34, a second side wall 36, a top wall 38 and a bottom wall 40 that all connect to a back wall 42. A dividing wall 44 is mounted vertically in casing 26 and is generally parallel to first side wall 34. A first compartment 46 is defined between first side wall 34 and dividing wall 44 and a second compartment 48 is defined between dividing wall 44 and second wall 36. The purpose of the two compartments will be discussed herein.

Referring again to FIG. 2, the handbrake mechanism of the present invention can generally be separated into three distinct parts: a handle ratchet mechanism 50, a quick release mechanism 52 and a chain drum mechanism 54.

Handle mechanism 50 comprises handle 14, a ratchet wheel 56, a pawl 58, a spring 60 and a pinion shaft 62. Handle 14 is formed in two halves which allows for the handle ratchet mechanism to be located in a compartment 15 formed in handle 14. Ratchet wheel 56 is placed in compartment 15 and is received on a first end 64 of pinion shaft 62 against a ledge 66 formed on the shaft. Shaft end 64 extends into handle compartment 15 and has a polygonal shaped cross-section that matches to a polygonal shaped bore 68 formed through ratchet wheel 56. The polygonal shaped bore and shaft end rotationally lock the ratchet wheel to the shaft. Ratchet wheel 56 defines a plurality of teeth 70 on an outer circumference thereon that interengage with pawl 58. Pawl 58 is rotatably mounted in compartment 15 about a pawl shaft 72 that is received through a bore 74 formed through pawl 58. Spring 60 is mounted in compartment 15 proximate pawl 58 such that the spring rotationally biases pawl 58 into engagement with ratchet wheel teeth 70. Handle 14 is axially secured to shaft end 64 by a fastener 76 and washer 78 into bearing 79. Fastener 76 is threadedly received in a blind bore formed in shaft end 64.

Quick release mechanism 52 comprises a quick release handle 16, a ratchet wheel 80, a pawl 82 and two mounting shafts 84 and 86. Quick release handle 16 is rotatably mounted in first compartment 46 about a shaft 86. Shaft 86 is formed with threads on a first end 86*a* and a slot on a second end 86*b*. Thus, shaft 86 is threadedly received in a threaded bore (not shown) formed in dividing wall 44 and can be positioned using a flat head screwdriver engaged in slotted shaft second end 86*b*. Ratchet wheel 80 defines a plurality of teeth 88 on an outer circumference thereon and a splined bore 90 therethrough that is countersunk on a side facing handle 14. Ratchet wheel 80 is received on a splined portion 92 of pinion shaft 62 such that the countersunk portion of the bore is adjacent a smooth surface 94 of pinion shaft 62. Splined bore 90 and pinion shaft splines 92 rotationally fix ratchet wheel 80 to pinion shaft 62. A bearing 96 is received in an opening 98 formed in first side wall 34 and rotationally supports pinion shaft 62 at shaft smooth surface 94. The bearing facilitates rotation of the shaft during operation.

Pawl 82 is rotationally received in compartment 46 about shaft 84. Shaft 84, like shaft 86, has a threaded first end 84*a* and a slotted second end 84*b*. Shaft 84 is threadedly received in a threaded bore (not shown) formed in dividing wall 44 and can be positioned using a flat head screwdriver engaged in slotted shaft second end 84*b*. Pawl 82 has two fingers 100 and 102, the former coupled with a spring and the latter received between two radial extensions 104 and 106 extending from quick release handle 16. Pawl finger 100 is coupled to a pivoting yoke pin 108 that receives a spring 110. The end of yoke pin 108 is received through a hole 109 (FIG. 3) so that as pawl 82 pivots about shaft 84, yoke pin 108 rotates about finger 100 while the compression of spring 110 is maintained against the surface defining hole 109. Second pawl finger 102 includes a threaded bore 112 that receives a threaded shaft 114. One end of shaft 114 extends through an oblong opening 120 formed through first side wall 32 and engages with a sustained release extension 122 on handle 14, as described herein.

Figure 3:
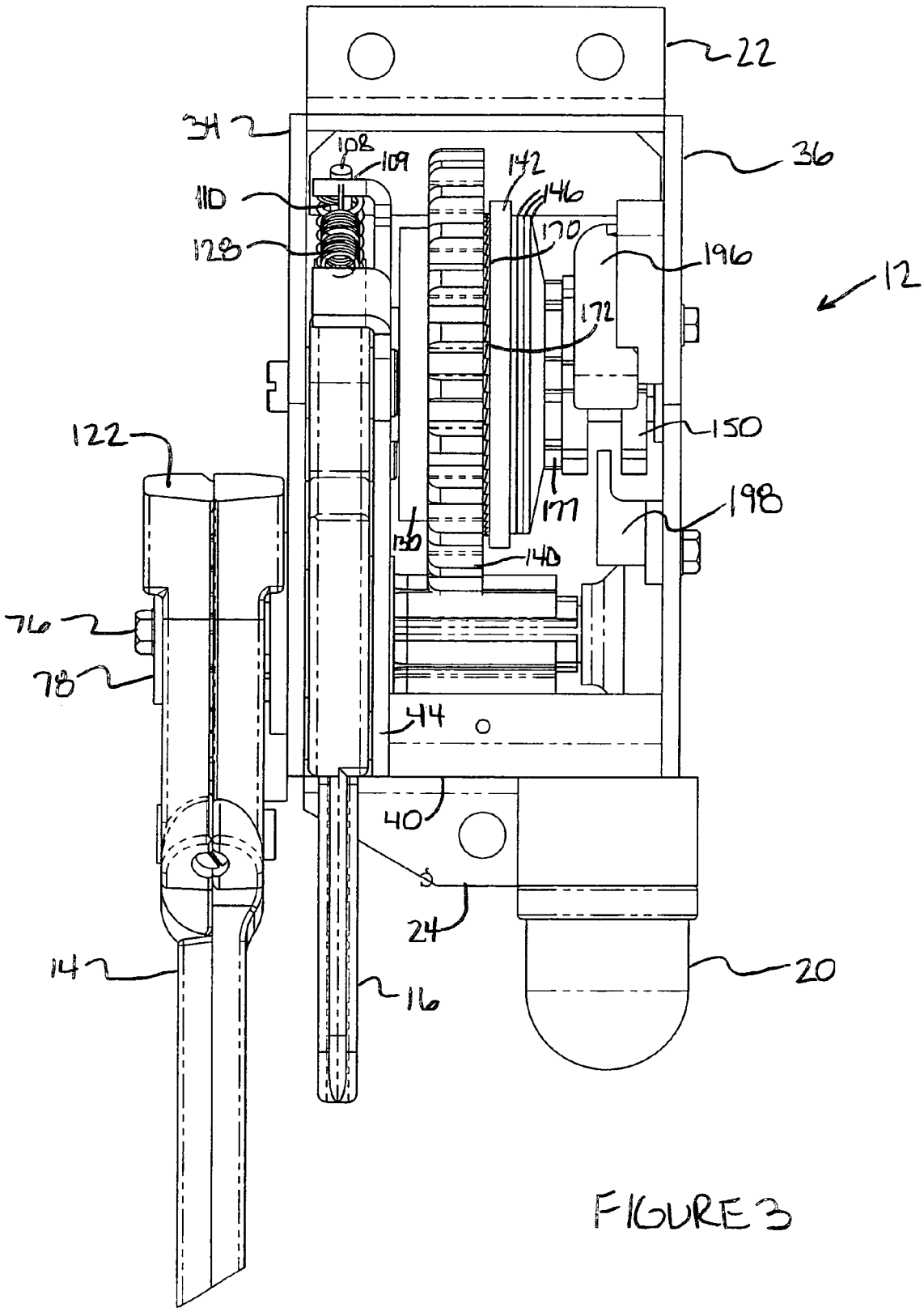
FIG. 3 is front view of the hand brake mechanism of FIG. 1, with the front housing cover removed.

Quick release handle radial extension 104 includes a opening 126 that receives one end of a spring 128, and the opposite end of spring 128 is coupled to top wall 38 (FIG. 3). Spring 128 biases the quick release handle into a vertical resting position, as shown in FIGS. 1 and 3. In particular, when quick release handle 16 is rotated upward and released, spring 128 biases the handle back down into its resting position.

Still referring to FIG. 2, chain drum mechanism 54 includes an adjusting plate 130, a load plate 132, a first thrust washer 134, a thrust bearing 136, a second thrust washer 138, a gear wheel 140, a first coupler 142, spring plates 146, a splined hub 148 and a chain drum 150.

Adjusting plate 130 is generally circular in shape and contains a bore therethrough. Three load screws 152 are received in respective threaded bores 154, which extend from the opposite side of adjusting plate 130 into contact with load plate 132. Load plate 132 contains a bore therethrough that defines a plurality of radially inward pointing splines 156. Thrust bearing 136 contains a plurality of radially oriented rollers 158, and is sandwiched between thrust washers 134 and 138. A bearing 160 is received in a bore 162 formed through gear wheel 140. Gear ring 140 defines a plurality of teeth 164 on an outer circumference thereon that interengage with a plurality of gear teeth 168 on pinion shaft 62. Spring plates 146 are Belleville type spring plates, model no. 096042 manufactured by Dodge. Hub 148 is generally cylindrical in shape and contains a plurality of axially extending splines 176 formed on an outer circumference thereof. Additionally, hub 148 contains a discontinuous radially extending flange 177 formed at a first end 179 thereof. Chain drum 150 contains a plurality of radially extending teeth 182 that engage the loops of chain 18.

In one preferred embodiment, first coupler 142 contains a plurality of axially extending teeth 170 that couple with a plurality of axially extending teeth 172 (FIG. 3) on a second coupler 174 (FIG. 4) that is rotationally and axially fixed to gear wheel 140 by weldments or other suitable means for fastening the two parts together such as rivets or staking. First coupler 142 further defines a plurality of radially inward extending splines 178 formed on an inner circumference of a bore 180 formed therethrough. First coupler 142 is formed from AISI 1144 steel and second coupler 174 is formed from AISI 1141 steel. The material for each coupler is oil quenched to 48 to 52 Rockwell C hardness and tempered at 600 degrees Fahrenheit to 40 to 44 Rockwell C hardness. The ramp angles of each tooth on the couplers are formed at a 10 degree angle. It should be understood that second coupler 174 may be formed integrally with gear wheel 140.

Figure 4:
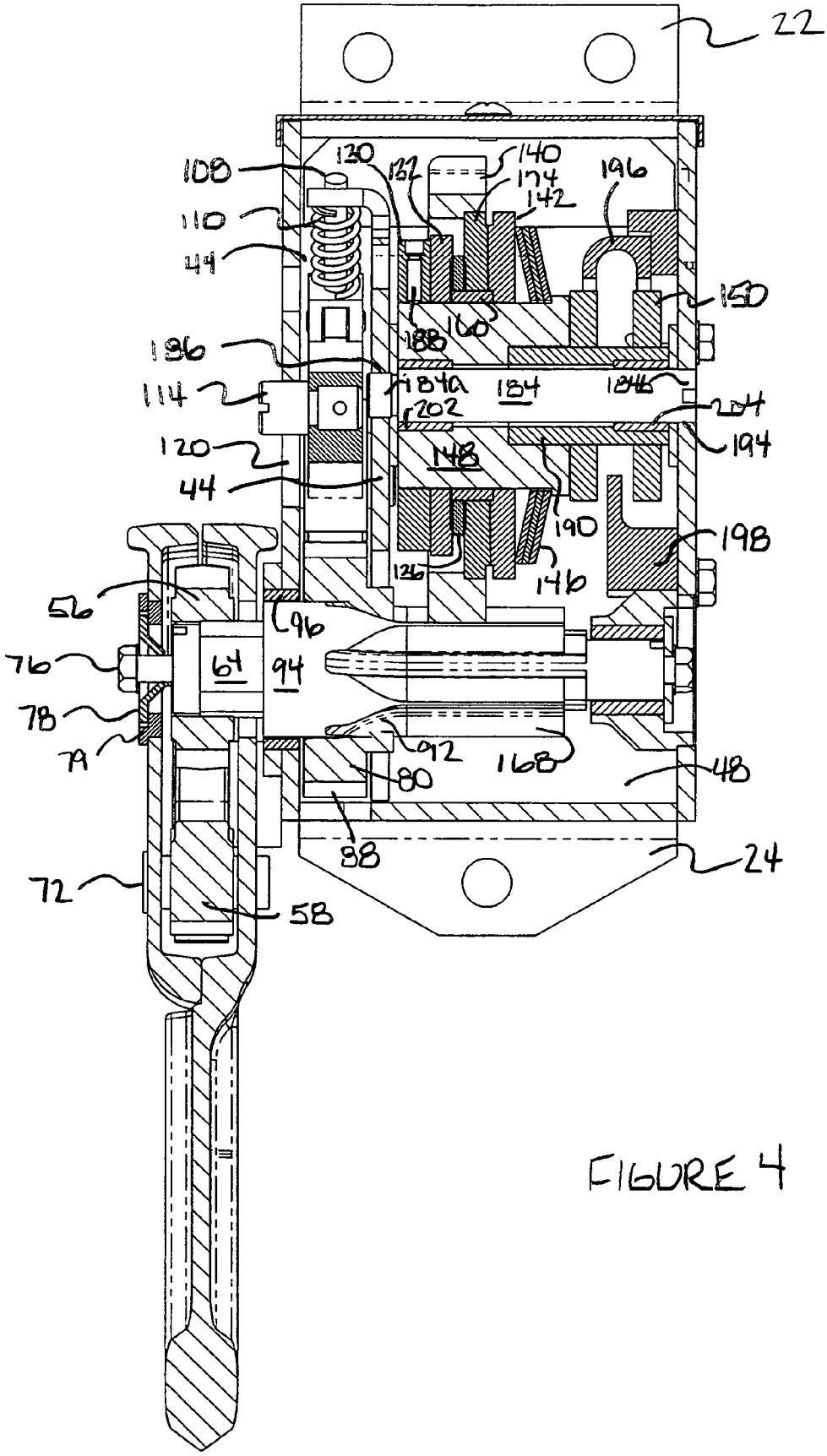
FIG. 4 is a cutaway view of the handbrake mechanism of FIG. 1 along lines A-A.

The connection of the parts of the gear mechanism 54 will now be described with reference to FIGS. 3 and 4. Each of the parts of gear mechanism 54 is mounted directly or indirectly on an output shaft 184 (FIG. 4). Output shaft 184 is threaded on one end 184*a* thereof and is threadedly received in a threaded bore 186 formed in dividing wall 44. A second end 184*b* of output shaft 184 is received in an opening 194 (FIG. 2) formed in second side wall 36.

Chain drum 150 is rotatably received on output shaft 184 over a bearing 204. Hub 148 is received over output shaft 184 and is rotationally fixed to the chain drum by a polygonally shaped blind bore 190 formed in hub 148 that receives a polygonally shaped portion 192 of chain drum 150. Spring plates 146 are placed on hub 148 so that the inner diameter of the spring plates abut hub flange 177. Next, first coupler 142 is inserted on hub 148 so that first coupler splines 178 engage with hub splines 176 rotationally fixing first coupler 142 to hub 148. Gear wheel 140 is rotatably received on hub 148 and rotates about the hub on bearing 160. First coupler 142 and gear wheel 140 are positioned such that first coupler teeth 170 engage with second coupler teeth 172. Thrust washers 134 and 138 and roller bearing 136 are placed on hub 148 adjacent to gear wheel 140. Load plate 132 is received on hub 148 adjacent to thrust washer 134 and is rotationally fixed to the hub via load plate splines 156 and hub splines 176. Lastly, adjusting plate 130 is threadedly received on hub 148 by a threaded inner bore 189 formed through adjusting plate 130 and a thread 191 formed on an end of hub splines 176. Thus, once adjusting plate 130 is threaded onto hub 148, it is rotationally fixed to the hub via a set screw 188 (FIG. 2). This set screw may also be a radial pin press-fitted into a bore. An inner bore 189 of adjusting plate engages with threads 191 formed on the end of hub splines 176.

Referring to FIG. 4, a chain guide 196 is secured to second side wall 36 proximate chain drum teeth 182. Chain guide 196 facilitates the proper orientation of chain 18 as it rides on chain drum teeth 182. A chain stripper 198 mounted proximate to the bottom of chain drum 150 strips chain 18 off of chain drum teeth 182 to ensure that the chain does not stick to the teeth as they rotate around output shaft 184. Two bearings 202 and 204 are received on output shaft 184, the first inside hub 148 and the second inside chain drum 150.

The operation of handbrake 10 is described herein with reference to FIGS. 4 and 5A-5C. To begin operation of the handbrake, the operator lifts upward on handle 14, which in turn imparts counterclockwise rotation on ratchet wheel 56 (with respect to FIG. 4 looking to the right). As ratchet wheel 56 rotates counterclockwise, pinion shaft 62 also rotates counterclockwise due to the coupling of polygonal pinion shaft portion 64 and polygonal ratchet wheel bore 68. Ratchet wheel 80 also rotates counterclockwise with pinion shaft 62 due to the interaction of pinion shaft splines 92 and ratchet wheel splines 90 (FIG. 2). As ratchet wheels 56 and 80 rotate, their respective pawls 58 and 82 ratchet over their respective teeth and into engagement with successive teeth, which prevents rotation of the ratchet wheels in the clockwise direction.

As pinion shaft 62 rotates counterclockwise, pinion teeth 168 interengage with gear wheel teeth 164 causing gear wheel 140 to rotate clockwise. Gear wheel 140 can rotate with respect to adjusting plate 130 and load plate 132 because of roller bearing 136 and plain bearing 160. Gear wheel 140 can also rotate with respect to first coupler 142 when the first coupler teeth are not engaged with second coupler teeth 172. As a result of the interconnection of all of the parts, first coupler 142 and second coupler 174 rotationally fix gear wheel 140 to chain drum 150 through hub 148. Thus, as the gear wheel rotates clockwise the hub and chain drum also rotate clockwise causing the chain to be pulled upward through housing 12. Upward tension on chain 18 causes the railway car brakes to engage to hold the car stationary.

The connection of first coupler 142 to second coupler 174 is facilitated by the interaction of first coupler teeth 170 and second coupler teeth 172 (FIG. 3). In particular, adjusting plate 130 is axially fixed to hub 148 and exerts axial pressure (to the right with respect to FIG. 4) against load plate 132 by load screws 152. Therefore, the axial load against gear wheel 140 and second coupler 174 can be adjusted by turning load screws 152. At the opposite side of hub 148, spring plates 146 exert an axial load (to the left with respect to FIG. 4) against first coupler 142, thereby pressing first coupler teeth 170 against second coupler teeth 172. As previously discussed, each of coupler teeth 170 and 172 are angled at 10 degrees such that the face of one tooth matches up to the face of an opposite tooth (FIG. 5A).

The angle of each tooth is chosen so that a predetermined input force can be exerted on handle 14 and chain 18 before the coupler teeth slip over each other. Thus, if the rotational torque exerted by the movement of lever 14 is less than the input set point sufficient to cause the coupler teeth to slip over each other, then once handle 14 reaches the top of its full swing, the operator lowers the handle to return it to vertical.

As handle 14 is lowered, pinion shaft 62 is held rotationally still since pawl 82 restricts the rotation of gear wheel 80 in the clockwise direction. Because pawl 58 will ratchet over ratchet wheel teeth 70, the handle will rotate clockwise with respect to ratchet wheel 70. Once handle 14 is substantially vertical, the operator once again lifts up on handle 14 and additional input force is exerted on pinion shaft 62. As such, pinion shaft gear teeth 168 rotate in the counterclockwise direction (looking to the right with respect to FIG. 4) causing gear wheel 140 to rotate clockwise. As long as the input force exerted between the couplers remain less than the predetermined input set point, movement of handle 14 upward will cause chain drum 150 to exert tension on chain 18.

Figures 5A, 5B, 5C:
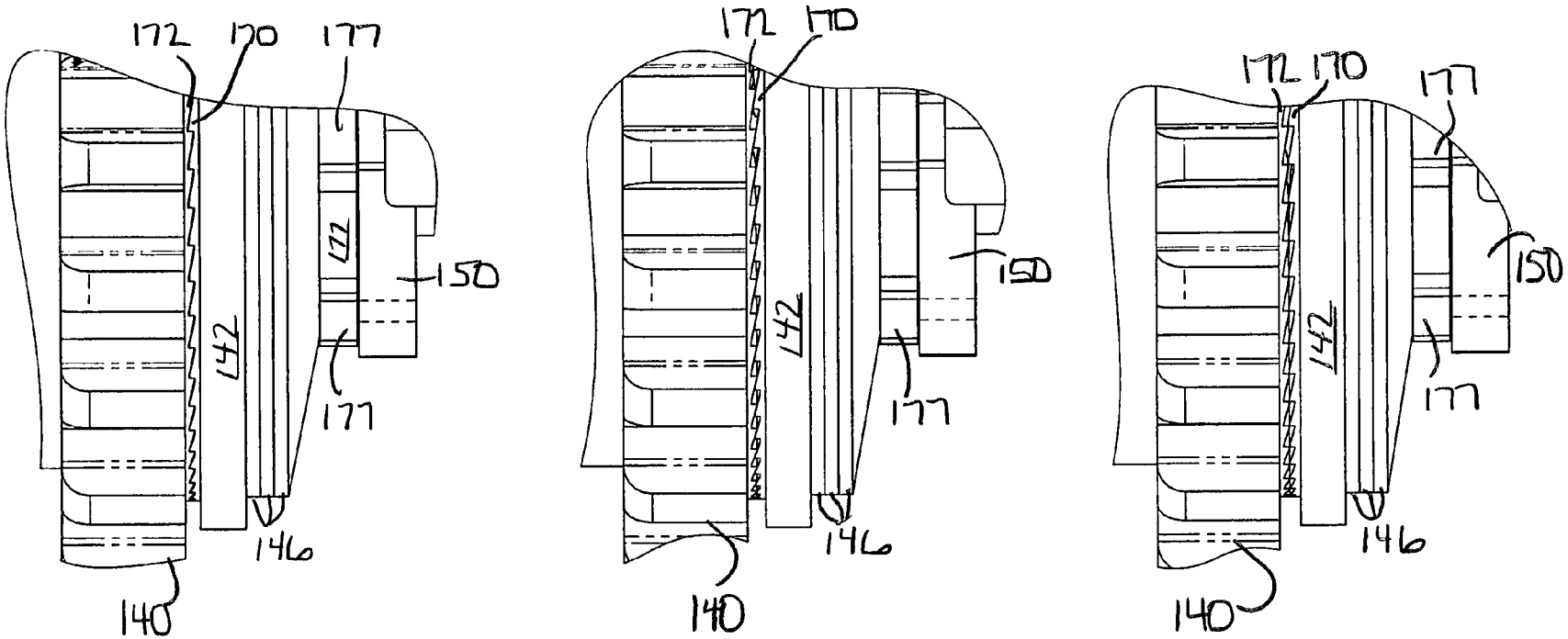
FIGS. 5A-5C are partial front views of the coupler mechanism used in the handbrake mechanism of FIG. 1.

Referring to FIG. 5B, first coupler teeth 170 are shown beginning to slip over second coupler teeth 172. This occurs because the input force exerted by the operator on handle 14 is nearing the axial force exerted by spring plates 146. As the force exerted on handle 14 nears the predetermined input set point, first coupler 142 begins to move axially to the right (with respect to FIGS. 4 and 5B) and the first coupler teeth 170 begin to slip over second coupler teeth 172. Once the input force on handle 14 reaches the predetermined input set point, first coupler 142 moves axially further to the right and first coupler teeth 170 slip completely past second coupler teeth 172. Based on a 10 degree tooth angle, the axial displacement of first coupler 142 with respect to second coupler 174 is 0.041 inches. Once the coupler teeth slip past each other, a loud clicking noise is generated to alert the user that the maximum input force has been achieved. Therefore, the couplers act as a torque indicator to alert the user when the proper input force has been exerted on the railway car brake rigging. After the maximum input force has been reached, additional rotation of handle 14 will not impart additional tension on chain 18 by chain drum 150. Thus, the couplers prevent the operator from over applying the brake rigging or under applying the rigging since the user should continue to rotate lever 14 until the clicking noise is heard.

To release the tension exerted on chain 18, the operator lifts quick release handle 16. Referring to FIGS. 2 and 3, as handle 16 rotates about shaft 86, handle radial extension 104 exerts downward pressure on pawl finger 102. As a result, pawl 82 is forced to rotate about pawl shaft 84 causing a third pawl finger 200 (FIG. 2) to disengage from ratchet wheel 80. Once third pawl finger 200 disengages from ratchet wheel 80, pinion shaft 62 is free to rotate in the clockwise direction (looking to the right with respect to FIGS. 2 and 3). Accordingly, gear wheel 140 rotates counterclockwise with hub 148 allowing chain drum 150 to release the tension on chain 18. Pawl 82 is maintained in the quick release position even after quick release handle 16 is released since yoke pin 108 rotates over center and spring 110 exerts a bias to maintain the pawl in the released position. In order to reapply tension on chain 18, handle 14 is once again lifted. As the handle rotates counterclockwise, sustained release handle extension 122 exerts an upward force on the end of threaded shaft 114 causing the pawl to rotate counterclockwise on shaft 84 moving third pawl finger 200 back into engagement with the teeth on ratchet wheel 80.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to these embodiments since modifications can be made. Therefore, it is contemplated that any and all such embodiments are included in the present invention as may fall within the scope and spirit thereof.

What we claim:

1. A brake mechanism for actuating a brake rigging of a railway car, said brake mechanism comprising:

a. a housing;

b. a handle mechanism coupled to said housing having, (i) a first handle, (ii) a first shaft rotatably received in said first handle and said housing, (iii) a first ratchet wheel rotationally fixed to said first shaft, and (iv) a first pawl coupled to said first handle and in operative engagement with said first ratchet wheel, where said first pawl is biased into engagement with said first ratchet wheel to rotationally fix said first ratchet wheel to said first handle in a first direction while allowing said first handle to rotate with respect to said first shaft in an opposite second direction, c. a quick release mechanism mounted in said housing and in operative engagement with said first shaft, said quick release mechanism having, (i) a second handle rotatably coupled to said housing, (ii) a second ratchet wheel rotationally fixed to said first shaft, and (iii) a second pawl rotatably coupled to said housing and in operative engagement with said first and said second handles, said second pawl moveable between a first engaged position with said second ratchet wheel and a second disengaged position, and d. a chain drum mechanism having, (i) a second shaft, (ii) a first gear connected to the railway car brake rigging, (iii) a second gear rotatably mounted on said second shaft and in operative engagement with said first shaft, and (iv) a clutch mounted on said second shaft intermediate said first gear and said second gear, wherein said clutch is moveable between a first position in which said first gear is rotationally coupled to said second gear, and a second position in which said first gear rotates with respect to said second gear.

2. The brake mechanism of claim 1, wherein said first shaft defines axial splines thereon and said second gear is in operative engagement with said first shaft axial splines so that rotation of said first shaft in said first direction causes said second gear to rotate in said opposite second direction.

3. The brake mechanism of claim 1, a. said second gear defining a plurality of ramped teeth on an end thereon, and b. said clutch defining a plurality of ramped teeth on an end thereon, wherein said second gear and said clutch are positioned so that said second gear teeth and said clutch teeth are in engagement with each other, when said second gear rotates in said second opposite direction, said second gear can rotate with respect to said clutch when a predetermined input torque on said first shaft is reached, and said second gear is rotationally fixed with said clutch in said first direction.

4. The brake mechanism of claim 3, said clutch further comprising:

a. a splined hub rotatably received on said second shaft, said splined hub being rotationally fixed to said first gear;

b. a coupler received on, and rotationally fixed to, said splined hub, said coupler positioned between said second gear and said splined hub;

c. at least one spring intermediate said splined hub and said coupler for biasing said coupler into engagement with said second gear, wherein said clutch teeth are formed on said coupler; and d. an adjusting plate for adjusting the level of said predetermined torque.

5. The brake mechanism of claim 1, wherein when said second handle is rotated in said first direction, said second handle causes said second pawl to move into said second disengaged position allowing said first shaft to rotate in said opposite second direction.

6. The brake mechanism of claim 1, further comprising a chain in operative engagement with said first gear and the railway car brake rigging such that rotation of said first shaft in said first direction causes said chain to engage the railway car brake rigging.

7. The brake mechanism of claim 5, wherein said second pawl is releasably maintained in said second disengaged position.

8. The brake mechanism of claim 7, wherein when said first handle is rotated in said first direction, said first handle biases said second pawl into said first engaged position so that said first shaft is prevented from rotating in said opposite second direction.

9. A brake mechanism for actuating a brake rigging of a railway car, said brake mechanism comprising:

a. a shaft having axial splines formed on one end thereof;

b. a handle rotatably coupled to said shaft, wherein said handle is rotationally fixed to said shaft in a first direction and rotates relative to said shaft in an opposite second direction;

c. a first gear connected to the railway car brake rigging;

d. a second gear in operative engagement with said shaft splines; and e. a clutch operatively disposed between said first gear and said second gear, said clutch having, (i) a coupler for rotationally coupling said first gear and said second gear, (ii) at least one spring operatively disposed intermediate said first gear and said second gear for biasing said coupler into engagement with said second gear;

wherein said coupler is moveable between a first position in which said first gear is rotationally coupled to said second gear, and a second position in which said first gear rotates with respect to said second gear.

10. The brake mechanism of claim 9, wherein rotation of said shaft in said first direction causes said second gear to rotate in said opposite second direction.

11. The brake mechanism of claim 9, wherein a. said second gear defines a plurality of ramped teeth on an end thereon, b. said coupler defines a plurality of ramped teeth on an end thereon, and c. said second gear plurality of teeth and said coupler plurality of teeth are sloped at an angle between 5 and 20 degrees.

12. The brake mechanism of claim 9, said clutch further comprising a splined hub rotationally fixed to said first gear and said coupler, wherein said coupler rotates with respect to said second gear when an input torque on said shaft exceeds a predetermined level.

13. The brake mechanism of claim 12, further comprising an adjusting plate for adjusting the level of said predetermined torque.

14. The brake mechanism of claim 12, wherein said predetermined torque is between 110 and 140 pounds of torque force.

15. The brake mechanism of claim 9, further comprising:

a. a first ratchet wheel rotationally fixed to said shaft; and b. a first pawl rotatably mounted to said handle and proximate to, and in operative engagement with, said first ratchet wheel, wherein said first pawl rotationally fixes said handle to said shaft in said first direction and allows said handle to rotate with respect to said shaft in said opposite second direction.

16. A brake mechanism for actuating a brake rigging of a railway car, said brake mechanism comprising:

a. a housing;

b. a first shaft having axial splines formed on one end thereof;

c. a first handle rotatably coupled to said first shaft, wherein said first handle is rotationally fixed to said first shaft in a first direction and rotates relative to said first shaft in an opposite second direction;

d. a second handle rotatably coupled to said housing, e. a pawl in operative engagement with said first handle and said second handle;

f. a ratchet wheel rotationally fixed to said first shaft, wherein said ratchet wheel rotates in said first direction but is rotationally fixed in said second opposite direction by said pawl;

g. a first gear operatively connected to the railway car brake rigging so that when said first gear is rotated in said opposite second direction a force is applied to the railway brake car rigging;

h. a second gear rotatably mounted in said housing and in operative engagement with said first shaft so that rotation of said first shaft in said first direction causes said second gear to rotate in said second opposite direction, and i. a clutch mounted intermediate said first gear and said second gear, wherein said clutch rotationally fixes said first gear and said second gear in said opposite second direction when an input torque applied to said first shaft is at or below a predetermined level, but allows said second gear to rotate with respect to said first gear when said input torque is above said predetermined level.

17. The brake mechanism of claim 16, said clutch further comprising:

a. a splined hub; and b. a coupler rotationally fixed to said splined hub, wherein said splined hub and said coupler are positioned intermediate said first and said second gears, said splined hub is rotationally fixed to said first gear, and said coupler rotates with respect to said second gear when said input torque on said first shaft exceeds said predetermined torque level.

18. The brake mechanism of claim 16, wherein said predetermined torque is between 110 and 140 pounds of torque force.

19. The brake mechanism of claim 16, further comprising a chain coupled between said first gear and the railway car brake rigging such that rotation of said first shaft in said first direction causes said chain to apply said force on the railway car brake rigging.

20. The brake mechanism of claim 16, wherein said second handle is for disengaging said pawl from said ratchet wheel when said second handle is rotated in said first direction to allow said first shaft to rotate in said second opposite direction thereby releasing said force on the railway car brake rigging.

* * * * *